US005673495A

United States Patent [19]

Jilek et al.

[11] Patent Number: 5,673,495

[45] Date of Patent: Oct. 7, 1997

[54] SINGLE-TIER DRYING SECTION WITH TOP-FELTED SERPENTINE DRYER SECTION AT DRY END THEREOF

[75] Inventors: Ronald F. Jilek, Appleton, Wis.; Markus Oechsle, Bartholomae, Germany

[73] Assignee: Voith Sulzer Papiermaschinen GmbH, Germany

[21] Appl. No.: 542,385

[22] Filed: Oct. 12, 1995

[51] Int. Cl.[6] ..... F26B 3/00

[52] U.S. Cl. ..... 34/458; 34/117

[58] Field of Search ..... 34/419, 420, 421, 34/444, 448, 452, 453, 454, 455, 456, 461, 462, 463, 464, 465, 117, 114, 115, 120, 458

[56] References Cited

U.S. PATENT DOCUMENTS 5,062,216 11/1991 Hannigan ..... 34/117 X
5,269,074 12/1993 Sims et al. ..... 34/117
5,283,960 2/1994 Sims et al. ..... 34/117
5,404,653 4/1995 Skaugen et al. ..... 34/117
5,426,867 6/1995 Yli-Kauppila et al. ..... 34/452
5,507,104 4/1996 Skaugen et al. ..... 34/117
5,524,360 6/1996 Virta et al. ..... 34/457

*Primary Examiner*—John M. Sollecito
*Assistant Examiner*—Steve Gravini
*Attorney, Agent, or Firm*—Ostrolenk, Faber, Gerb & Soffen, LLP

[57] ABSTRACT

A drying section of a papermaking machine is constituted of a plurality of top-felted single-tier drying section which terminate with one or at most two two-tier sections which are both top-felted. The invention allows broke to fall by gravity, greatly facilitating broke removal and recycling. Moreover, the location of the double-tiers at the end of the drying sections affords opportunity for controlling curl.

29 Claims, 4 Drawing Sheets

SINGLE-TIER DRYING SECTION WITH TOP-FELTED SERPENTINE DRYER SECTION AT DRY END THEREOF

BACKGROUND OF THE INVENTION

The present invention relates to the drying section of a papermaking machine and, more particularly, to a drying section comprised substantially entirely of sequentially arranged top-felted, single-tier dryer sections with one or at the most two top-felted, serpentine dryer sections at the dry end thereof.

As used herein, the term "drying section" refers to that part of a papermaking machine which receives a web of paper emerging from the press section and extending to the point where the paper web reaches a dryness of about 90–99%, before entering subsequent sections of the machine, e.g. the calender, the coater, after dryer, etc. As is well known, a drying section consists of several subsections comprising commonly felted drying cylinders. In the present patent specification the term "dryer group" or "dryer section" designates a group of commonly felted dryer cylinders, except in the case of a double-tier dryer section where the co-extensive upper and lower dryers, although separately felted, are still considered to be the same "dryer section."

Although single-tier dryer sections comprising a plurality of drying cylinders with intermediate vacuum rolls have been known for a very long time, at least since 1951, see e.g. U.S. Pat. No. 2,537,129 to Goodwillie, single-tier dryer sections have become more popular relatively recently, in the early 1980's when they have been proposed and incorporated in drying sections located in North America, Europe and Japan.

Initially, single-tier dryer sections were located only in the beginning stages, i.e. in the first three dryer sections, of the overall drying section. Later, with the objective of increasing the runnability of drying sections, the papermaking machine suppliers have begun to propose and construct drying sections comprised solely of single-tier dryer sections.

As exemplified by the present patent assignee's, U.S. Pat. No. 5,184,408, initially all single-tier dryer sections were constructed of all single-tier dryer sections in which the single-tier dryer sections alternated between top-felted and bottom-felted dryer sections, throughout the drying section. Also exemplifying this trend are U.S. Pat. Nos. 5,065,529, 5,144,078 and 5,146,696.

In time, the industry became aware of certain drawbacks associated with alternating, top-felted and bottom-felted single-tier designs, ensuing from the fact that bottom-felted single-tier dryer sections, unlike top-felted sections, do not permit broke to fall down by gravity, which is highly desirable. This presents a severe disadvantage because a considerable amount of time and effort is needed to clean out bottom-felted single-tier drying sections after a web break.

Recognizing the above drawback of alternating, single-tier drying sections, the present assignee (The Voith Sulzer company) has proposed (in its pending U.S. patent application Ser. No. 08/151,255) arranging substantially all of the single-tier dryer sections to be top-felted and allowing the drying process to be concluded with one or two conventional, double-tier dryer sections located at the very end of the drying section. Methods for threading the paper web from the single-tier dryer sections to the double-tier dryer sections are disclosed in the present assignee's U.S. Pat. No. 5,232,554.

Such a drying section, substantially consisting of only top-felted single-tier dryer sections which end with a double-tier dryer section, is also described in U.S. Pat. No. 5,269,074, and has been proposed by the Voith company to several customers in the United States and abroad, as early as 1990. As described in the aforementioned 5,269,074 patent, providing an all top-felted single-tier drying section which ends with a single double-tier dryer section affords the paper maker the opportunity to control curl which may set into a paper web when it is dried solely from one side thereof, as is the case with an all top-felted single-tier dryer section. An all top-felted single-tier drying section which ends with one double-tier dryer section was designed and built by the present assignee, and is presently operating at the Appleton Papers, Inc. paper mill in Appleton, Wisconsin. It is the only operating drying section of its kind in the United States.

As a result of its intensive design efforts and operating experience with the single-tier dryer sections of the above types, the present patent assignee now recognizes that it is highly desirable to continue to construct drying sections designed as all top-felted, single-tier dryer sections which end with one or two conventional, double-tier dryers. Double-tier dryer sections provide certain advantages including the aforementioned ability to control curl, more compactly placed drying cylinders which shortens the overall length of the machine, open draws of the web between the drying cylinders which (unlike single-tier dryers) allow the paper web to relax between dryers and so achieve very high dryness levels on the order of about 98%–99% without bursting or exploding, a location for a tail cutter, and other benefits.

Nonetheless, conventional double-tier dryer sections do have their disadvantages. One disadvantage is that the paper web travels in open draws between dryers, where it is subject to flutter and is more prone to break, particularly when one contemplates future machines running at much higher speeds. Second, the arrangement of dryers and felts in a double-tier drying section creates closed pockets between the dryers, which undesirably traps humidity and broke.

Accordingly, the general objective of the present invention is to retain the advantages of a drying section constructed substantially entirely of top-felted single-tier dryer and ending with a means for controlling curl at the dry end of the dryer section, while avoiding the drawbacks of a conventional double-tier dryer section.

SUMMARY OF THE INVENTION

Accordingly, it is an object of the present invention to provide a drying section consisting substantially of only top-felted single-tier dryer sections, which end with one or at most two final dryer sections which can be utilized for purposes of controlling curl.

It is another object of the present invention to provide the drying section of the above type in which control of possible curl is realized by use of one or at most two serpentine dryer sections at the end, following the all top-felted dryer sections.

It is a further object of the present invention to provide a drying section in which the paper web travels together with felts, i.e. without open draw, substantially throughout the drying section.

It is a further object of the present invention to provide a drying section which has an overall length which is shorter, as compared to an all single-tier drying section.

It is a further object of the present invention to provide a drying section in which the paper web is protected substantially throughout the drying section against fluttering.

It is also an object of the present invention to provide a drying section in which all of the dryer sections thereof are top-felted.

The foregoing and other objects of the invention are realized by a drying section design which comprises a plurality of top-felted, single-tier dryer sections wherein the paper web is conducted from one dryer section to the next dryer section substantially in a closed, supported draw, all the way through to one (or at most two) last dryer section which is a serpentine dryer section. As is well known, paper makers have designed and constructed serpentine dryer sections since the early 1970's. In a serpentine dryer section, the drying cylinders are arranged in two tiers, but only a single-felt traverses both the upper and the lower drying cylinders. In a top-felted serpentine dryer section, the paper web contacts directly only the upper tier of drying cylinders and indirectly the lower drying cylinders, since the fabric or felt is interposed between the paper web and the lower drying cylinders. Nonetheless, a certain amount of heat penetrates through the comparatively open mesh fabric to dry the side of the paper web which is in contact with the felt, affording the opportunity for curl control.

Advantageously, the drying cylinders in the serpentine dryer section of the present invention may be of the type whose peripheral surfaces are grooved and a vacuum may be drawn along the grooves to hold the web against the fabric by vacuum, as disclosed for example in U.S. Pat. No. 4,359,827 and in the present assignee's U.S. Pat. No. 5,311,672. The contents of the 4,359,827 and 5,311,672 patents are incorporated by reference herein. In this connection, it is also noted that European patent publication EP 0 334899B1 (W/O 88 04206) shows in FIG. 1 thereof a plurality of top-felted dryer sections which are followed by one serpentine top-felted dryer section and thereafter by a bottom-felted serpentine dryer section. That reference is silent as to what other types of drying cylinders follow the partially illustrated drying section. In any event, such a dryer section does not meet the objective of providing an all top-felted dryer section and further does not disclose the novel concept of controlling curl with a single top-felted serpentine dryer section.

Other features and advantages of the present invention will become apparent from the following description of the invention which refers to the accompanying drawings.

DETAILED DESCRIPTION OF EMBODIMENTS OF THE INVENTION

Figure 1A:
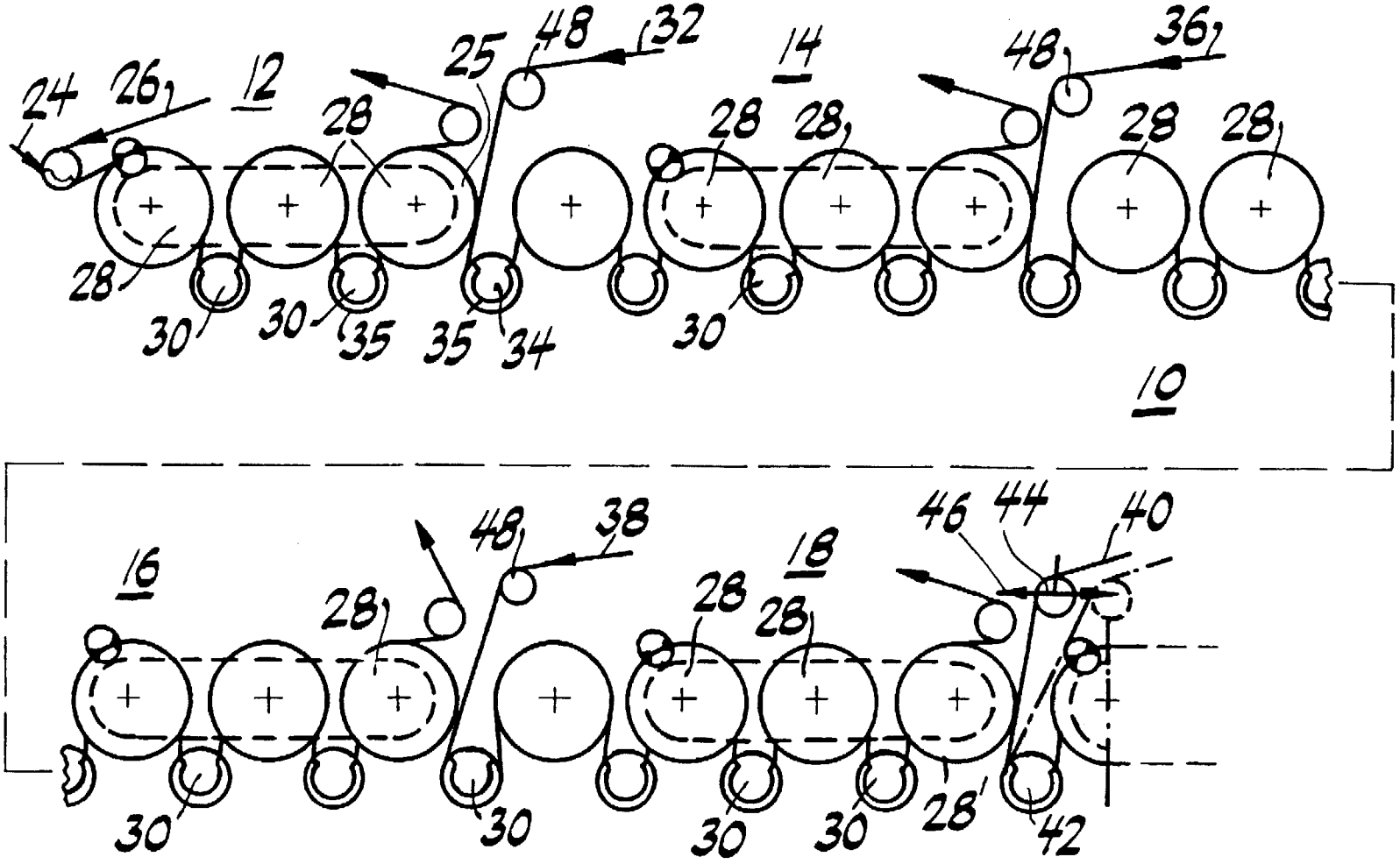
FIGS. 1A and 1B illustrate a drying section comprising a plurality of top-felted dryer sections, ending with two final serpentine, top-felted dryer sections.
Figure 1B:
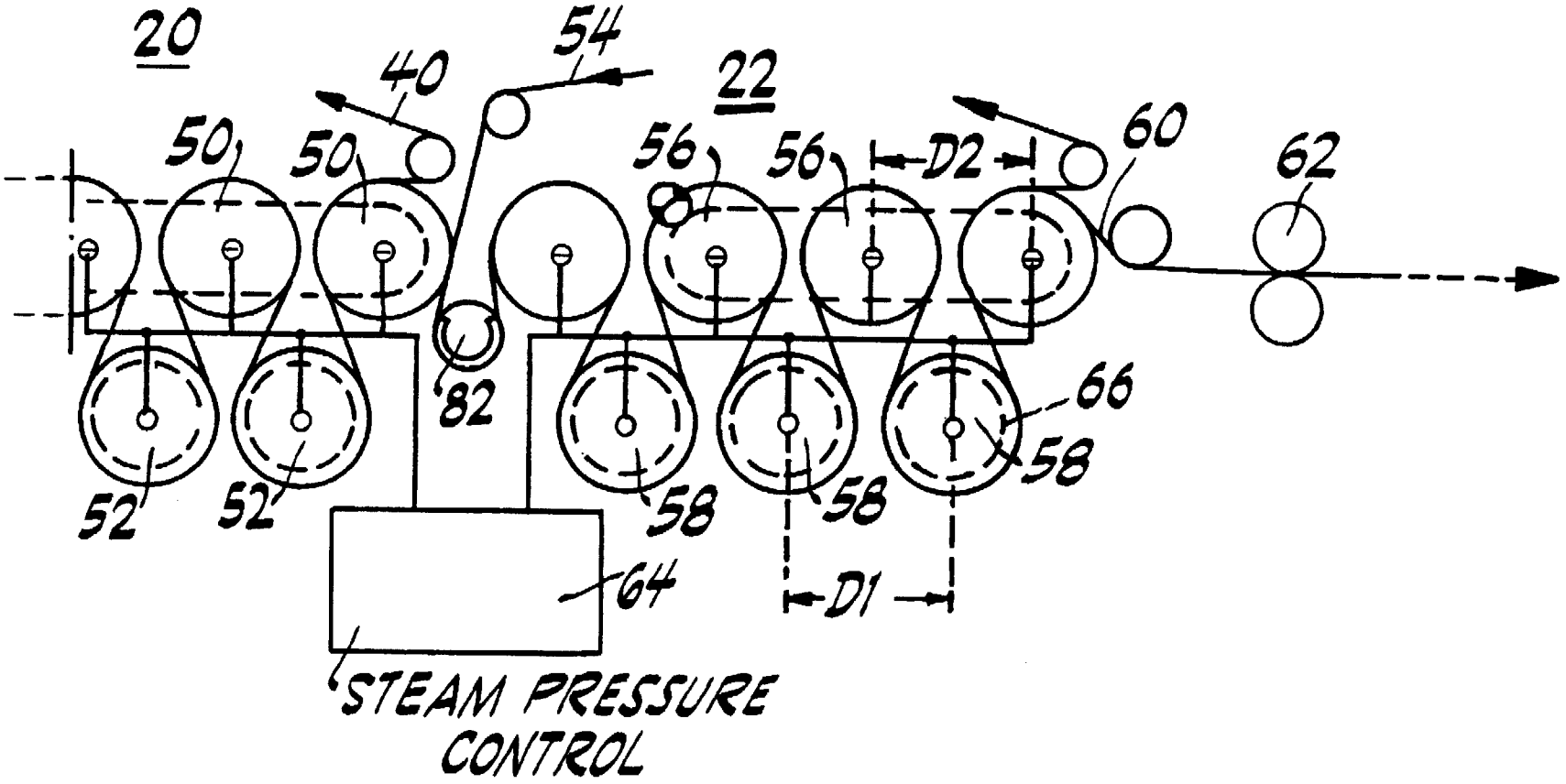

Referring to FIGS. 1A and 1B, the drying section 10 of the present invention includes first, second, third and fourth top-felted, single-tier dryer sections 12, 14, 16 and 18, respectively, and ends with a first, top-felted, serpentine dryer section 20 and a second, serpentine top-felted dryer section 22. In well known manner, the paper web 24 enters the first top-felted single-tier dryer section 12, travelling jointly with the felt 26 thereof about its drying cylinders 28 and vacuum rolls 30.

The paper web 24 is picked off the exposed surface 25 of the last dryer 28 of the dryer section 12 by the felt 32 due to a vacuum exerted by the first vacuum roll 34 of the second top-felted single-tier drying section 14, in a manner which is well known in the art and referred to as a "lick-down" transfer. In the same fashion, the paper web 24 then continues to the second and third dryer sections 16, 18 travelling with their respective felts 36 and 38, over and about their drying cylinders 28 and intermediate vacuum guide rolls 30.

As further illustrated in FIGS. 1A and 1B, the paper web 24 is picked-off the exposed surface of the last dryer 28' of the fourth dryer section 18 by the felt 40 and the leading vacuum roll 42 of the first serpentine dryer section 20, using the same type of lick-down transfer described above. Note that the felt 40 travels about a felt roll 44 which is horizontally movable as indicated by the arrows 46 to open (if desired) the draw between the last top-felted, single-tier dryer section 18 and the first serpentine dryer section 20. The same type of mechanism for opening the draw between dryer sections can be provided by making the other felt rolls 48 horizontally movable in the manner of the felt roll 44.

Once the paper web 24 has entered the first serpentine dryer section 20, the bottom side of the web directly contacts the upper dryers 50 while the top face of the web contacts indirectly the lower drying cylinders 52, as shown. Drying of the paper web is completed in the last serpentine dryer section 22 which includes a felt 54, upper drying cylinders 56 and lower drying cylinders 58. The paper web exits after being picked off the last drying cylinder 56 at the point 60 and is thereafter guided downstream, to a calender 62 and/or other sections of the papermaking machine.

The present invention affords several advantages. First, since all of the dryer sections including the serpentine dryer sections 20 and 22 are top-felted, in the event of web break, broke simply falls by gravity toward the floor or more accurately to the basement below the machine, where it can be economically repulped and recycled. It also facilitates directing the leading end of the paper web to the basement during threading operations. Further, the serpentine dryer sections 20 and 22 of the present invention do not have the closed pockets which characterize conventional double-tier dryer sections. Moreover, these serpentine dryer sections do not have bottom felts which, when present, occupy a large space under the drying cylinders and also require expensive felt rolls and other accessories.

Still, the serpentine dryer section(s) of the present invention permit curl control in the conventional manner as by providing a central controller 64 (or discrete pressure regulating control valves) for controlling the steam pressures in the top dryers 50 and 56 of the first and second dryer sections to create a steam pressure differential between these top dryers and the bottom dryer 52 and 58. The mechanisms and control modes for effecting curl control are well known in the art and need not be described here.

Another advantage of the serpentine dryer sections 20 and 22 ensues from the fact that the lower dryers 52 and 58 are almost as large or of the same size as the upper dryers 50 and 56. Further, these lower dryers are situated at some distance from the upper dryers so that the joint run of the web and felt between the lower and upper dryers is at least one foot and as much as about 3 feet in length. Consequently, the present invention provides a comparatively long evaporation path for the paper web while it travels between dryers. This enhances the drying process. The lower dryers 52 and 58 may be ordinary dryers just like the upper dryers or, alternatively, they can be grooved dryers as indicated by the dashed line 66. Moreover, it is not necessary that the lower dryers be steam heated. Rather, they can be apertured dryers with a vacuum drawn on their interiors. This aids the evaporation process and enhances the drying of opposite sides of the paper web. Indeed, curl control can be effected in this type of an arrangement by controlling the steam pressure in the top dryers and the vacuum levels in the interiors of the bottom cylinders.

It is contemplated that the paper web 24 might enter the serpentine dryer sections while it is about 70% to 80% dry and exit the drying section approximately 98% dry or in the range of from 95% to 99.2% dry, depending upon paper grade, machine speed, and steam pressures.

Figure 2:
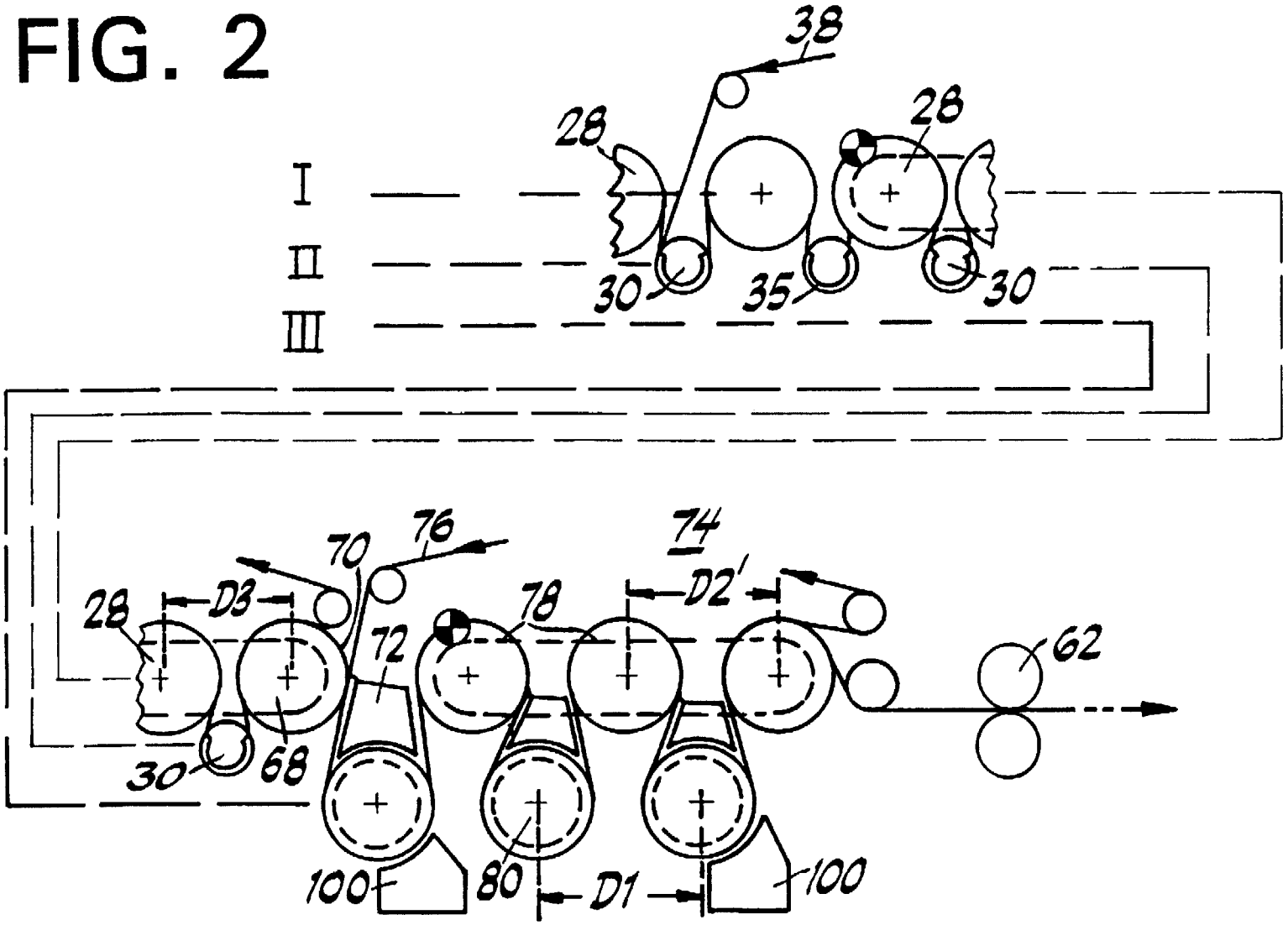
FIG. 2 shows another variant of the present invention in which the drying section includes one final serpentine dryer section which uses grooved cylinders and vacuum boxes to provide larger evaporation paths.

Referring now to FIG. 2, it is preliminarily noted that this figure, like FIGS. 1A and 1B, is intended to merely illustrate the overall configuration of the novel drying section according to the present invention. The actual number of single-tier, top-felted dryer sections can be larger or smaller than the four sections shown in FIGS. 1A and 1B. The drying section of FIG. 2 includes a last single-tier dryer 68 which has an exposed surface 70 from which the paper web 24 is picked off by suction supplied by vacuum box 72 of the last serpentine dryer section 74, which also includes a felt 76 which traverses its upper dryers 78 and lower grooved dryers 80. The outer circumferential surfaces of these lower dryers 80 support a vacuum supplied by the vacuum boxes 72, holding the web tightly against the outer surface of the felt 76 in well known manner. Although the first dryer of the last serpentine dryer group is a large grooved cylinder, the web may instead be picked off by a vacuum roll, as by the vacuum roll 82 depicted in the leading position of the last dryer section 22 of FIGS. 1A and 1B.

In FIGS. 1A, 1B and 2, the vacuum rolls 30, 34 are illustrated with internal vacuum boxes 35 which produce a zone of vacuum in these rolls that is confined substantially to the roll surface which is traversed by the felt/web joint run. However, these vacuum rolls can alternatively be constructed as gutless rolls with perforated circumferences and associated vacuum boxes disposed above or below, as described for example in U.S. Pat. No. 4,359,827 and in numerous other publications. Indeed, the rolls 30 may be constructed as grooved rolls which operate without any vacuum, particularly for use with certain paper grades and slower machine speeds. The design of the present invention is suitable for producing not only paper web but also heavier grades such as liner board, etc. In the serpentine dryer sections 20 and 22 of FIGS. 1A and 1B, the distances D2 and D1 can be approximately the same. In FIG. 2, the distances D2' and D1 are preferably larger than the cylinder to cylinder separation in the single-tier dryers which is given as D3. Also note the heights of the axes of rotation of the various cylinders which lie in planes I, II and III, respectively, for the upper dryers 28, 78; the vacuum rolls 30; and the lower cylinders 80.

The drying section of FIG. 3 includes the plurality of single-tier, top-felted dryer sections of FIG. 2, but differs in the following respects. Here, the paper web 24 passes in an open draw 90 to a bottom-felted, serpentine dryer section 92 in which the top side of the paper web 24 directly contacts the steam heated drying cylinders 78 which are located at the bottom tier. Note that the felt 76 which is top-felted in FIG. 2 is bottom-felted in this figure. This serpentine dryer section 92 includes the grooved cylinders 80 and vacuum boxes 72 in the upper tier position. Although broke removal is more difficult, the fact that the top side of the paper web 24 directly contacts the heated lower drying cylinders 78 is an advantage.

The paper web passes to one very last dryer section 94 which consists of two dryers 96 and a vacuum roll 98. The open draw provided between the dryer sections 92 and 94 permits the positioning of a normal tail cutter S at the position indicated. Alternatively, a water jet tail cutter may be positioned at S' to cut a tail on the web while it is travelling against the surface of the last dryer 96. During a tail cutting operation, the paper web 24 may be directed toward a broke pulper (not shown). In the embodiment of FIG. 3, the dryers 28 of the top-felted, single-tier dryer sections are located at a height indicated by plane I, while the upper dryers of the inverted serpentine sections are at a higher plane II and its lower dryers 78 are at a plane III which is located below the plane I.

Figure 3:
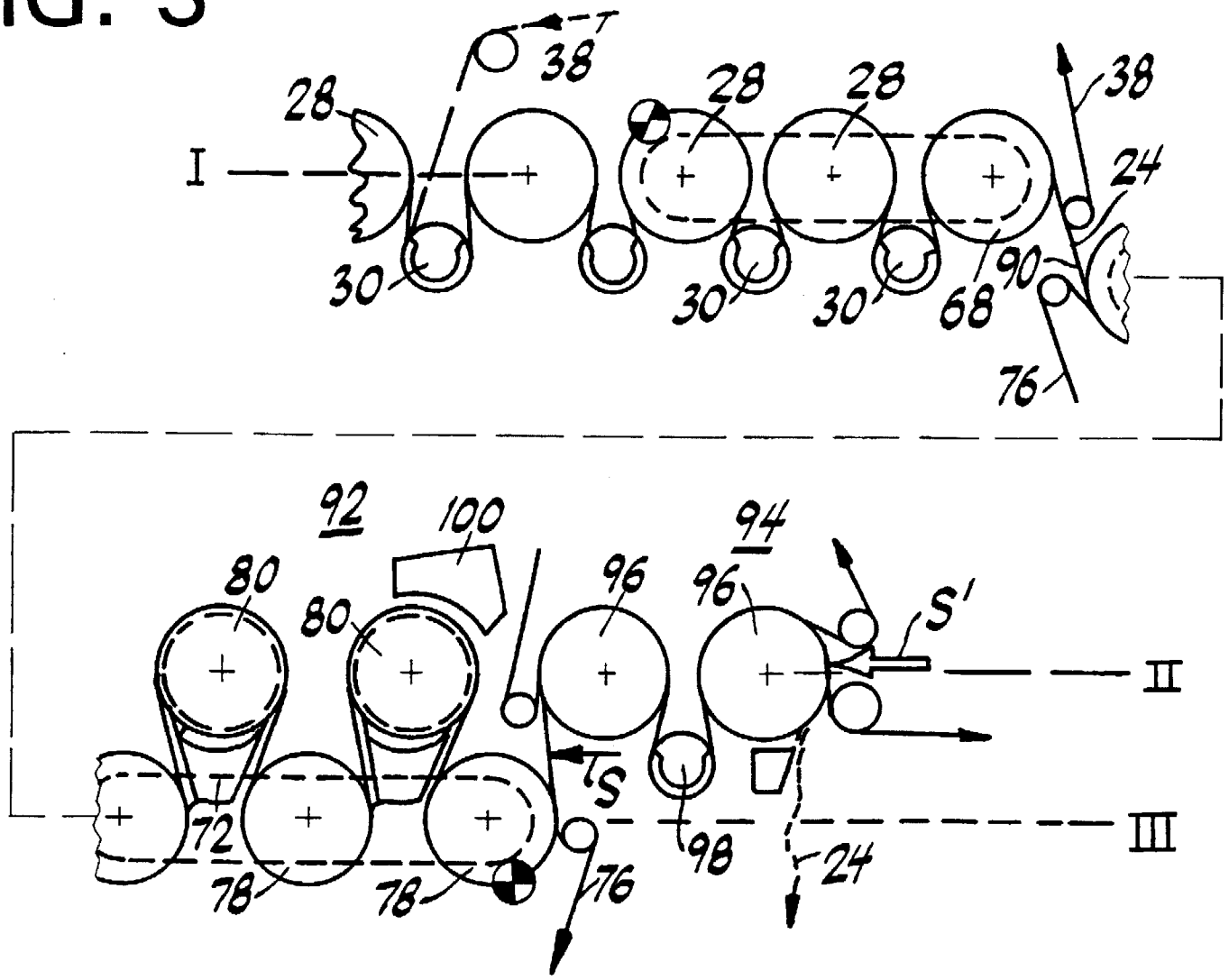
FIG. 3 illustrates yet another embodiment of the present invention.

In both FIGS. 3 and 2, suction blow boxes 100 may be provided for removing moist air being evaporated from the paper web. These suction blow boxes 100 may include a suction chamber (not shown) and should preferably be disposed so as to envelop the illustrated grooved rolls 80 in FIGS. 2 and 3 as well as the grooved rolls 52 and 66 in FIGS. 1A and 1B, over approximately one-fourth of their peripheries, namely in the second half of the zone looped by the respective felt of the particular dryer section. These suction blow boxes 100 can be provided where shown in the drawings and also over other ones of the aforementioned grooved cylinders 80, 52, 66. By removing moisture, the profiling of the paper web and control of curl is improved.

Thus, contrary to the prior art which has always placed serpentine dryer section only at the beginning or at the center of a drying section, the present inventors have conceived using these serpentine dryer sections at the very end of the drying section for the purposes of and to obtain the advantages indicated above.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drying section for a papermaking machine, the drying section comprising:

a first drying section portion including a plurality of dryer sections a majority of which are configured as single-tier, top felted dryer sections which directly follow one another, each of said dryer sections including a plurality of drying cylinders and a respective felt, the respective felt being guided so that each said dryer section is top-felted, the drying section further including a final dryer section which is configured as a serpentine, top-felted dryer section, said serpentine dryer section comprising an upper tier of heated drying cylinders, a lower tier of heated drying cylinders and a single felt which traverses both the upper and lower tiers of drying cylinders, the felt of the serpentine dryer section contacting the lower tier cylinders directly and the upper tier cylinders indirectly via a paper web such that the paper web is between the felt and the upper tier cylinders.

2. The drying section of claim 1, in which the drying section includes a next-to-last dryer section which is also configured as a serpentine, top-felted dryer section.

3. The drying section of claim 1, including a respective guide roll located below and between adjacent ones of said drying cylinders of each of said top-felted, single-tier dryer sections.

4. The drying section of claim 3, in which the guide roll is a vacuum roll.

5. The drying section of claim 3, in which the guide roll is a gutless, perforated roll.

6. The drying section of claim 3, in which the guide roll is a grooved roll.

7. The drying section of claim 1, including means for controlling curl of the paper web, said curl control means being coupled to said serpentine, top-felted dryer section.

8. The drying section of claim 7, in which the serpentine dryer section includes an upper tier of drying cylinders and a lower tier of cylinders and the curl control means operates by creating a steam pressure differential which is set to control curl in said paper web.

9. The drying section of claim 8, in which the drying cylinders of said plurality of top-felted, single-tier dryer sections and the upper tier of drying cylinders of said serpentine, top-felted dryer section are located so that their axes of rotation lie in a same common plane I.

10. The drying section of claim 8, in which the lower tier of cylinders of the serpentine, top-felted dryer section are steam heated drying cylinders.

11. The drying section of claim 8, in which the lower tier cylinders of the serpentine dryer section are steam heated, grooved cylinders.

12. The drying section of claim 8, in which the lower cylinders and the upper cylinders have about equal diameters.

13. The drying section of claim 8, in which the lower cylinders are perforated cylinders and a vacuum is drawn internally of said lower cylinders.

14. The drying section of claim 8, in which the single-tier, top-felted dryer sections define for the paper web a first moisture evaporation path between the drying cylinders thereof and wherein the serpentine, top-felted dryer section defines for the paper web a second moisture evaporation path between the drying cylinders thereof, and wherein the second moisture evaporation path is substantially longer than the first moisture evaporation path.

15. The drying section of claim 14, in which the second moisture evaporation path is at least twice as long as the first moisture evaporation path.

16. The drying section of claim 8, in which the upper tier drying cylinders are separated by a first distance and wherein the drying cylinders within each of said plurality of single-tier, top-felted dryer sections are separated by a second distance and the first distance is larger than the second distance.

17. A drying section for a paper making machine for drying a paper web, the drying section comprising:

a plurality of dryer sections, the plurality of dryer sections including a first group of dryer sections consisting of a plurality of top-felted, single-tier dryer sections for directly heating a first side of the paper web and including at least one serpentine, bottom-felted dryer section following the first group of dryer sections for directly applying heat to a second side of the paper web, so as to affect a curl parameter associated with the paper web, said serpentine dryer section comprising an upper tier of drying cylinders, a lower tier of drying cylinders and a single felt which traverses both the upper and lower tiers of drying cylinders.

18. The drying section of claim 17, in which the at least one serpentine, bottom-felted dryer section consists of a single serpentine, bottom-felted dryer section.

19. The drying section of claim 17, in which the at least one serpentine, bottom-felted dryer section includes a bottom-tier of drying cylinders and a top-tier of cylinders.

20. The drying section of claim 19, in which the top-tier cylinders are heated drying cylinders.

21. The drying section of claim 20, in which the top-tier, heated drying cylinders are grooved drying cylinders.

22. The drying section of claim 19, in which the top-tier cylinders are vacuum rolls having a diameter about equal to a diameter of said bottom-tier drying cylinders.

23. The drying section of claim 19, further including a felt traversing the bottom-tier drying cylinders and the top-tier cylinders and wherein the paper web is guided in contact with the felt throughout the serpentine, bottom-felted dryer section.

24. The drying section of claim 17, further including a top-felted drying section comprising a pair of drying cylinders and a single intermediate paper web guiding roll interposed therebetween downstream of the at least one serpentine, dryer section.

25. The drying section of claim 24, further including an open draw of the paper web between the at least one serpentine, bottom-felted dryer section and the top-felted dryer section to provide a space to cut a tail in said paper web.

26. A method for drying a paper web emerging from a press section by using a drying section of a papermaking machine, the method comprising the steps of:

initially drying the paper web in the drying section by guiding the paper web through a plurality of dryer sections a majority of which are configured as single-tier, top felted dryer sections which directly follow one another, wherein each of said dryer sections includes a plurality of drying cylinders and a respective felt;

guiding the respective felt about the drying cylinders so that each of said dryer sections is top-felted; and in which the paper web is further guided to be dried in the drying section by conducting it through a final dryer section of said drying section which is configured as a serpentine, top-felted dryer section, said serpentine dryer section comprising an upper tier of drying cylinders, a lower tier of drying cylinders and a single felt which traverses both the upper and lower tiers of cylinders.

27. The method of claim 26, including controlling a curl parameter associated with the paper web with the serpentine, top-felted dryer section.

28. The method of claim 27, including providing a steam pressure differential between the upper-tier drying cylinders and the bottom-tier drying cylinders to control curl.

29. The method of claim 26, including controlling a steam pressure in one of the bottom-tier and the upper-tier of cylinders and a vacuum level in the other of said upper-tier and bottom-tier of cylinders to control curl.

* * * * *